United States Patent [19]

Berger et al.

[11] Patent Number: 4,768,766

[45] Date of Patent: Sep. 6, 1988

[54] SYSTEM AND METHOD FOR SELECTIVE ASSEMBLY AND IMAGING OF BOOKS

[75] Inventors: Joseph P. Berger, Winona Lake, Ind.; Mary F. Allsopp, Glasgow; Christopher D. Cook, Cave City, both of Ky.; Jonathan O. Fraleigh, Chicago, Ill.; David Hamilton, Canton, Ohio; John E. Kessberger, Warsaw, Ind.; Helen Maiorano, Cicero, Ill.; Stuart O. Rawlings, North Webster, Ind.; James L. Warmus, Chicago, Ill.; Janet A. Wilczynski, Willowbrook, Ill.; Did-Bun Wong, Elmhurst, Ill.

[73] Assignee: R. R. Donnelley & Sons Company, Chicago, Ill.

[21] Appl. No.: 854,314

[22] Filed: Apr. 21, 1986

[51] Int. Cl.[4] ..... B65H 39/02

[52] U.S. Cl. ..... 270/58; 400/126; 346/75; 364/478; 364/471; 270/21.1

[58] Field of Search ..... 270/54–58, 270/21.1; 400/126, 83, 80, 70, 71; 346/75; 364/178, 138, 188, 471

[56] References Cited

U.S. PATENT DOCUMENTS

| | | | |
|---|---|---|---|
| Re. 31,710 | 10/1984 | Jackson | 270/57 |
| 3,608,888 | 9/1971 | McCain et al. | 270/54 |
| 3,892,427 | 7/1975 | Kraynak et al. | 270/52 |
| 3,899,165 | 10/1978 | Abram et al. | 270/58 |
| 3,913,719 | 10/1975 | Frey | 101/374 |
| 3,917,252 | 11/1975 | Harder et al. | 270/58 |
| 3,972,521 | 8/1976 | Reed | 270/58 |
| 4,108,575 | 8/1986 | Morgan | 400/126 |
| 4,121,818 | 8/1975 | Riley et al. | 270/58 |
| 4,452,136 | 6/1984 | Boynton et al. | 400/70 |
| 4,462,701 | 7/1984 | Czyszczewski | 400/70 |
| 4,481,603 | 11/1984 | McCaskill et al. | 400/83 |
| 4,547,856 | 10/1985 | Piotroski | 270/56 |
| 4,556,959 | 12/1985 | Allen et al. | 400/70 |
| 4,568,072 | 2/1986 | Piotroski | 270/58 |
| 4,585,220 | 4/1986 | Zemke et al. | 270/58 |

FOREIGN PATENT DOCUMENTS

| | | | |
|---|---|---|---|
| 2501793 | 7/1975 | Fed. Rep. of Germany | 400/126 |
| 2734815 | 2/1978 | Fed. Rep. of Germany | 400/126 |
| 2542888 | 9/1984 | France | 400/83 |
| 2156558 | 10/1985 | United Kingdom | 400/70 |

OTHER PUBLICATIONS

"Teleconference Systems", IBM Tech. Discl. Bulletin, vol. 22, No. 9, 2–80, pp. 3923–3925.

"Video Terminal Controller", IBM Tech. Discl. Bulletin, vol. 27, No. 5, 10–84, pp. 2765–2766.

"Data Processor Setup Through an Operator Interactive Remote Display Terminal", vol. 26, No. 6, 11–83, pp. 3073–3074.

(List continued on next page.)

*Primary Examiner*—E. H. Eickholt

*Attorney, Agent, or Firm*—Wood, Dalton, Phillips, Mason & Rowe

[57] ABSTRACT

A system and method for assembling and binding books and for printing an address or a personalized message in accordance with coded information. The system includes a main control with a data processor and a memory for coded address and message information. One or more bindery lines each has means for gathering and assembling sections to form a book and for imaging the book with a personalized image. A line control has a data processor connected with the bindery line to control selection and assembly of signatures and imaging in accordance with the control information. Operator terminals at the main and line controls have visual display with touch screen operation input. A communication network connects the main control with each of the line controls. Address and control information from a magnetic tape is transferred to disk memory at the main control. This information is later transmitted over the communication network to the line controls. The vacuum valves of the bindery line signature delivery units and the operation of ink jet units to position message fields on the book are timed by observation of the operation of the line at slow speed and the entry of timing control information through an operator terminal.

2 Claims, 5 Drawing Sheets

OTHER PUBLICATIONS

"Interleaved-Graphics & Text", IBM Tech. Disclosure Bulletin, vol. 22, No. 11, 4-80, pp. 4813-4815.
"Tactile Switch Locator & Graphic Concept for Touch-Sensitive", Graphic Display Station", IBM Tech. Discl. Bull., vol. 28, No. 27-85, pp. 820-822.
"Interleaved Graphics & Text", IBM Tech. Discl. Bulletin", vol. 22, No. 11, 4-80, pp. 4813-4815.
"Split-Run", Book Production Industry, Mar. 1970, pp. 38-41.
"SplitRun", Book Production Industry, Mar. 1970, pp. 34-37.
"Facsimile Systems: As Urvey", Book Production Industry, Dec. 1969, p. 42.
"Touch Panel Attachment to CRT using light pen Interface", IBM Tech. Discl. Bull., vol. 26, No. 5, 11/83, pp. 2303-2305.
"Method For Interconnecting Two or More Asynchronous Microprocessors", IBM Tech. Discl. Bulletin, vol. 28, No. 4, 9/85, pp. 1402-1403.
"Keyboard Display Workstation", IBM Tech. Discl. Bulletin, vol. 22, No. 5, 10/79, pp. 2043-2044.
"Printer Data Processing/Word Processing Enhanced Controller System", IBM Tech. Discl. Bulletin, vol. 24, No. 11B, 4/82, pp. 5885-5887, 400/70.
"CRT Editing Terminals", Book Production Industry, 6/70, pp. 44-51.

SYSTEM AND METHOD FOR SELECTIVE ASSEMBLY AND IMAGING OF BOOKS

FIELD OF THE INVENTION

This invention is concerned with a system and method for assembling and binding books and for printing an address or personalized message in accordance with coded information.

BACKGROUND OF THE INVENTION

Systems for the selective or demographic assembly of books and for imprinting an address or personalized message are shown in Abram et al U.S. Pat. Nos. 3,899,165 and Riley et al. 4,121,818, both assigned to the assignee of this invention. The systems of Abram and Riley were implemented by applicant's assignee utilizing a DEC computer to control a bindery line.

The memory of the DEC computer limit the capacity and flexibility of the system. Certain setup features of the DEC system, as timing of the signature delivery mechanisms, have required revision of the computer program for each job. This is an expensive and time consuming procedure. Another specific problem with the DEC based system is control of the relative horizontal position of lines within multiple message fields.

SUMMARY OF THE INVENTION

A principal feature of the invention is the provision of a system for binding and imaging books which has a main control with a data processor, a memory for coded address and message data and control information and an operator terminal, a bindery line with means for selective gathering of signatures to form a book and for imaging the book with an address or personalized messages, a line control with a data processor and an operator terminal, connected with the bindery line to control signature selection and imaging, and a communication network for transmitting data and control information from the main control to the line control. The control information may include address and message information. More particularly, the main control is remote from the bindery line while the line control is located at the bindery line. A plurality of bindery lines, each with a line control are operated with a single main control so that work may readily be distributed to the bindery lines. The operater terminals for the main control and each line control preferably include a touch sensitive video display for the input of operator information.

Another feature of the invention is the method of translating address or control information from a magnetic tape to the line control data processor which includes reading the tape at the main control, recording the information in a high capacity memory, as disk storage, at the main control, subsequently reading the disk and transmitting the information to the line control. Reading the magnetic tape is a time consuming procedure. Preliminary transfer of the information from the tape to the disk to the main control facilitates distribution of the information to one or more line controls as needed for operation of the bindery lines.

A further feature is that timing of the vacuum valve controlling vacuum to the signature pickup of each signature delivery unit of the bindery line is established by moving the chain and signature delivery mechanisms at slow speed, observing for each signature delivery unit the time in the bindery line cycle at which the signature pickup engages the signature and setting the time of operation of the vacuum valve for each unit in accordance with the observed time. This timing method obviates the need for modifying the data processor program.

Yet another feature is the method of controlling ink jet operation for printing a message or address, which includes establishing a time period related to each signature position of the bindery line, the time period representing a fraction of the bindery line cycle, and initiating an operation of the ink jet printer upon sensing the presence of a signature during such time period.

Still a further feature is the method of selecting the position of the multiple message fields which includes observing the sensing of a signature to initiate a printing operation, determining the distance from the point at which the signature is sensed to the ink jet assembly, for each field, and adjusting the print time of the printer to position the first character of each field at the desired location.

Further features and advantages of the invention will readily be apparent from the following specification and from the drawings, in which.

The system disclosed herein illustrates the main and line controls as used with a saddle bindery where the selected signatures are deposited on and hang over a moving chain as the book is assembled. Features of the invention could be used with a perfect or square-back binding system in which the signatures are stacked on a conveyor. The patents of Abram et al. and Riley et al. illustrate mechanical aspects of the bindery line and features of selective gathering and imaging (printing). Some of these features are not shown in detail in this application. The disclosures of Abram et al. and Riley et al. are incorporated by reference herein; and familiarity with them will be assumed.

A typical job performed by the system is the assembly of a book, as a catalog or magazine, from preprinted page signatures. The name and address of the intended recipient and coded information directing the selection of pages and other book components and the messages to be printed are typically provided in the form of a magnetic tape. The books are customized by selecting the page signatures and other components, as return postcards, an order blank or the like, suitable for the intended recipient. The name and address are printed on the outside of the book for mailing purposes and appropriate messages may be printed inside the book.

Figure 1:
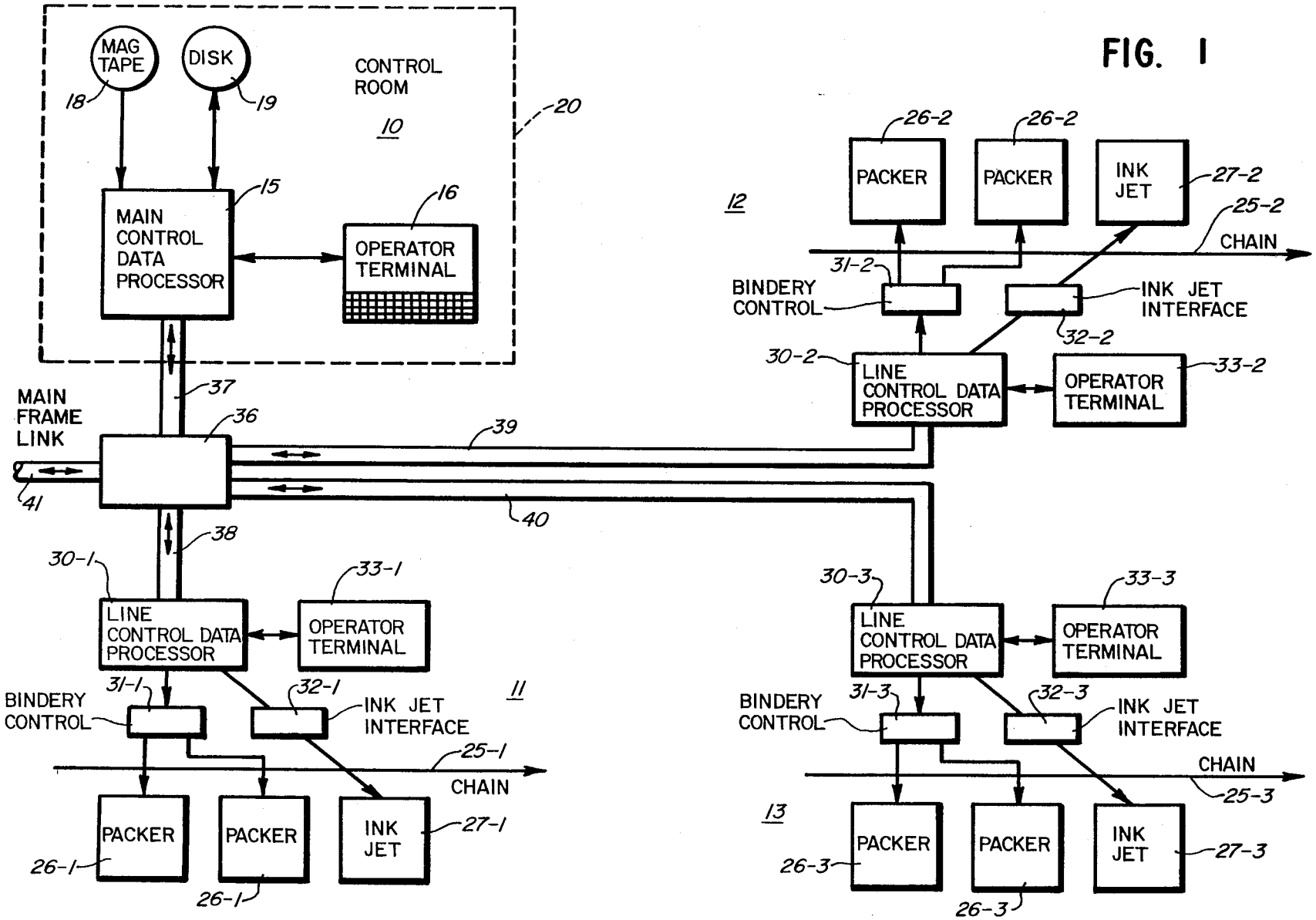
FIG. 1 is a simplified block diagram of a system illustrating the invention.

An embodiment of a system illustrating the invention is shown in FIG. 1. The system has a main control 10 and three bindery lines 11, 12 and 13.

The main control 10 includes a data processor 15, as an Intel 80286 microprocessor based computer. An operator terminal 16 has a touch screen for display of messages and program menus and for entry of information or instructions by an operator. Keyboard 17 provides an alternate means for information and message input. A magnetic tape reader 18 and a disk storage memory 19 are also connected with the main controller.

The main control 10 is preferably located at a point remote from the bindery lines and may be in an environmently controlled room as indicated by the dashed line enclosure 20. The equipment which is included in the main control is not exposed to the dusty environment of the bindery line.

The bindery lines 11, 12 and 13, to the extent they are illustrated in FIG. 1, are identical. Only one will be described. Corresponding elements in each bindery line will be identified by the same reference numerals with the suffixes −1, −2 and −3 representing lines 11, 12 and 13, respectively.

Each bindery line, shown in abbreviated form in FIG. 1, has a moving chain 25 on which the components of the book are assembled in the usual fashion. The chain moves past a plurality of signature delivery mechanisms or packer boxes 26 and a printing station 27 having one or more ink jet heads for printing a message on a page of the book. The printing operation is sometimes referred to as "imaging". The line control includes a line control data processor 30, as an Intel 80286 based computer. A bindery control 31 provides an interface between line control data processor and each of the signature delivery units or packers 26. An ink jet interface 32 is connected between the line control data processor 30 and ink jet station 27. An operator terminal 33 is connected with line control data processor 30 and includes a touch screen display for messages and program menus and for the entry of information or instructions by the line operator.

The main control data processor 15 is connected with each of the line control data processors 30-1, 30-2 and 30-3 by a star configured communication network. An industrial grade network developed by Xerox Corporation and sold by various vendors under the trademark ETHERNET, utilizing fiber optic data transmission links, is suitable. The main control data processor 15 is connected with a star junction 36 through link 37. Links 38, 39 and 40 connect each of the line control data processors 30-1, 30-2 and 30-3 with the junction 36. Means in the main control data processor directs control information to the data processor for each of the line controls. A link 41 may provide a connection with a main frame computer if desired. The ETHERNET network has a limited range. If bindery operations are at widely spaced geographic locations, the main control data processors may be interconnected in some other manner, as through a satellite link.

In the drawing the arrowheads on the connections between elements and in the data links indicate the direction of transfer of information. The main and line controls may have other elements useful in providing efficient operation. For example, printers may provide hard copyof messages, production records and the like. Audible and visual alarms may be included to alert the operators to an incoming message or to a system condition which requires attention.

Figure 2:
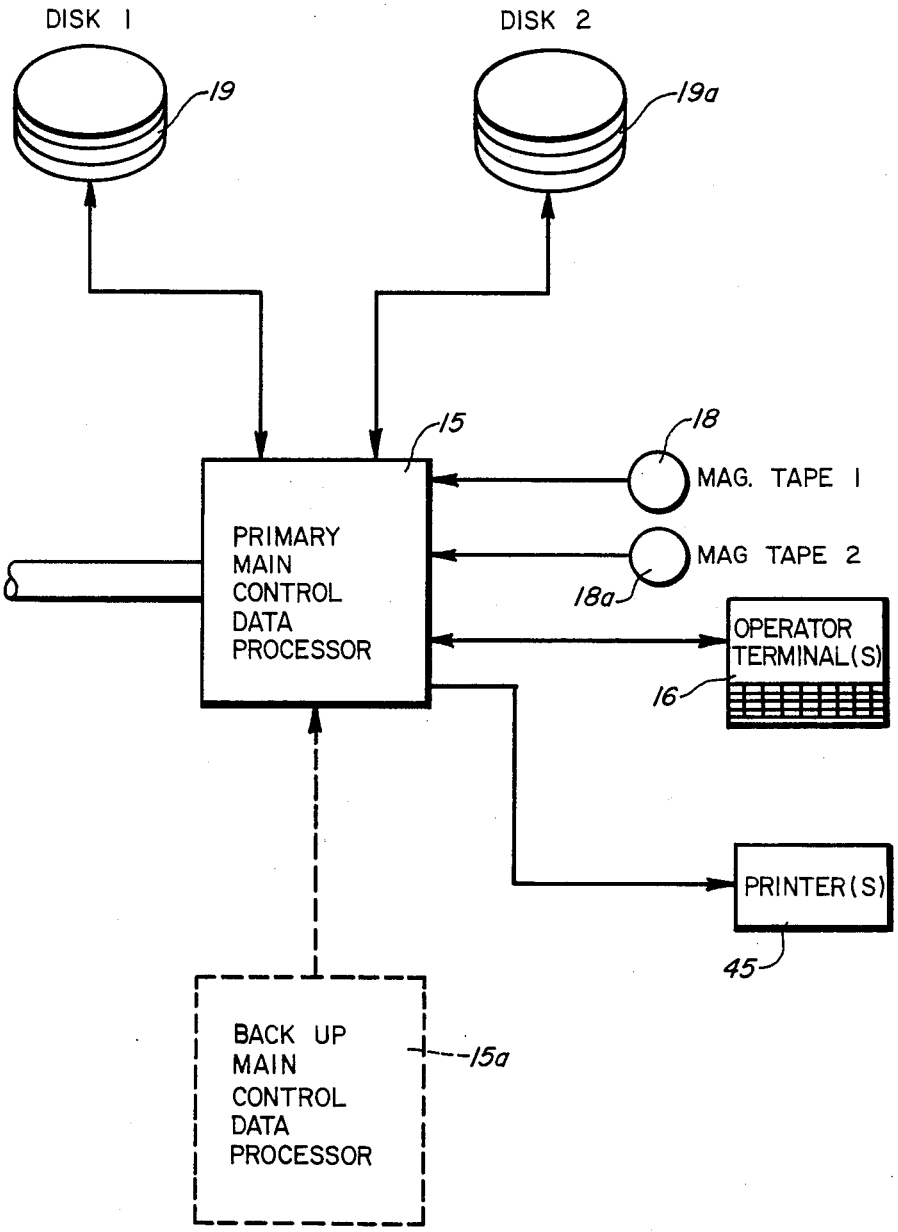
FIG. 2 is a diagrammatic block illustration of the main control.

The main control, FIG. 2, preferably has a backup data processor 15*a* to which system operation ban ce transferred in the event of a malfunction of the primary data processor 15. A second magnetic tape reader 18*a* and a second disk storage 19*a* provide for continued operation in the event of a reader or disk failure. Printer 45 provides hard copy records of system operation. Multiple operator terminals and printers may be utilized if desired, particularly where efficient system operation makes it desirable to have more than one operator. The redundant peripheral elements afford insurance against system shutdown in the event of an equipment failure.

Figure 3:
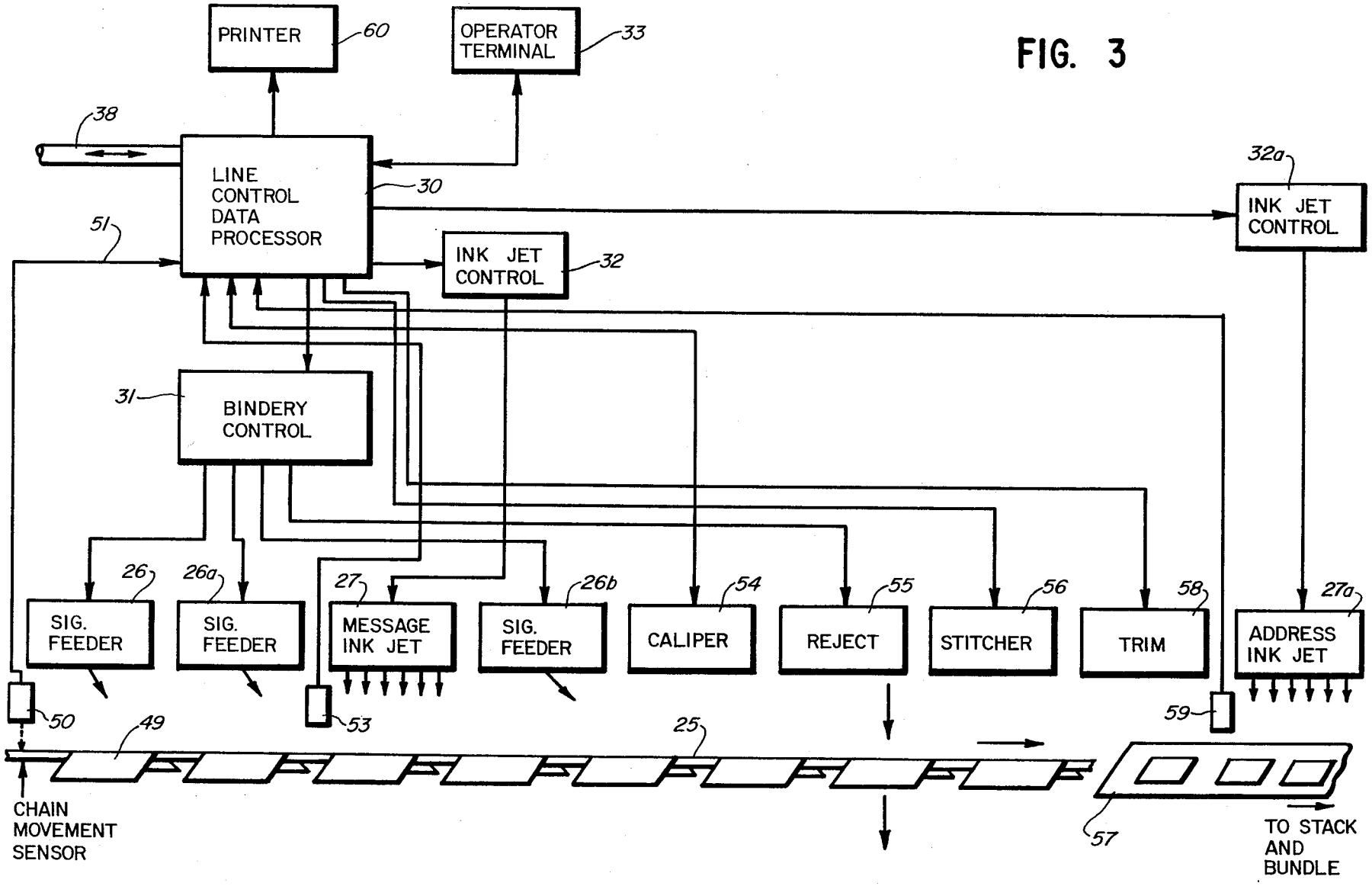
FIG. 3 is a diagrammatic block illustration of the bindery line and line control.

FIG. 3 illustrates diagrammatically principal elements of a bindery line control. Chain 25 on which books 49 are assembled is driven by motor 50. A signal representing chain movement is coupled to the line control data processor 30 as indicated at 51. Chain 25 has spaces for the successive assembly of a plurality of books. Devices utilized in the assembly and imaging of books and sensors which monitor certain bindery line functions are located along the chain. Signature feeders 26, 26*a* and 26*b* (sometimes referred to as packers or packer boxes) can deliver signatures to the chain as each book position passes. Three signature feeders are shown. A typical bindery line may have as many as fifty or sixty signature feeders. With selective assembly of a book, the book for a specific addressee is assigned by the line control data processor to each chain position. The appropriate signatures, as indicated by line controls is carried out without affecting the other line controls data processor in accordance with information from an address tape, are delivered to that position as the claim moves past the feeders. The signature feeder mechanism includes vacuum suckers which pick up the signature. For selective assembly, the vacuum is valved on and off at the various feeders to direct appropriate signatures to each chain space. A further discussion of the timing of this operation is given below.

A message ink jet 27 is located between feeders 26*b* and 26*c*, to print a message on an inside page of the book. A sensor 53 detects the presence of a signature and signals the bindery line data processor 31 which through interface control 32 initiates operation of the ink jet. Alternatively, an inside page of the book may be imaged downstream utilizing the system of Gruber et al. U.S. Pat. No. 4,395,031. The Gruber system would not normally be used, however, when the bindery line is selectively assembling books.

After a chain position has passed the last of the signature feeders, a caliper 54 senses the thickness of the book and a thickness signal is coupled to the line control data processor 31. If the book thickness is outside selected limits, the book is rejected and diverted from the chain at reject station 55.

Correctly assembled books are stapled at stitcher 56 and then removed from the chain 25 and transferred to a conveyor table 57. The edges of the book are trimmed at 58. Sensor 59 detects the presence of a book and data processor 31, through interface control 32*a*, initiates operation of ink jet printer 27*a* to image a name and address on the label area of the book.

The completed books continue to a stacking and bundling station (not shown). Typically, books are assembled in bundles by zip code to take advantage of postal discounts.

The operator terminal 33 has a visual display with touch screen input utilized in the setup and timing of the system, as will appear. A printer 60 provides hard copy of messages and reports. The ink jet interface controls 32, 32*a* provide an appropriate control protocol for the ink jet units 27, 27*a*. Ink jet units of different characteristics or from different manufacturers may be used, even mixed on the same job, without reprogramming line control data processor 30.

The main and line controls' through the touch screen operator terminals' provide for menu driven input of information regarding the physical characteristics of the bindery line and the requirements of jobs to be performed. The overall functions of the bindery line devices and controls are in many respects similar to the functions of the bindery lines of the Abram et al. and Riley et al. patents. The input of information, however, is handled by the technical operator at the main control and the machine operator at the bindery line control rather than requiring the services of a program engineer.

The physical characteristics of each bindery line, e.g., chain space options, the number and location of packer boxes and other device including ink jet printers, signature sensors, caliper, trimmer, stitcher, etc., and the timing of the packer boxes and printers are part of a machine setup file. The file is maintained on the disk of the main control data processor 15 and communicated to the line controller whenever needed.

When a bindery line is first used in a selective system, the technical operator at the main control data processor 15 creates the machine setup file. Thereafter, the file may be modified by either the technical or the machine operator. Some of the machine setup information, for example, the number and location of packer boxes and other devices, may be entered at either the main or line control. Other information, as packer or final ink jet timing, is preferably entered at the line control, but could also be entered at the main control if desired.

Several preparatory procedures are required before performing a binding run. First, address information must be entered into the system. Typically a catalog publisher will provide a printer with a magnetic tape names and addresses. The names and addresses should be grouped by zip code. For selective gathering and imaging the tape may also contain a code indicating book makeup and message selection. For a subscription magazine the code may identify subscribers whose subscription will expire shortly. A message will be included urging renewal of the subscription, and a renewal order blank will be inserted in the magazine. The magnetic tape information is transferred to disk memory 19 at the main control data processor 15. This procedure can be performed during a slack activity period prior to the time the binding run is scheduled.

Another preparatory procedure is the establishment of a software make-ready file. Again, a menu driven program displays a series of questions on the screen of the main control operator terminal 16 and the technical operator responds to the questions by entering appropriate information. A separate file is prepared for each bindery line on which the job will be run. The file describes various aspects of the job and how it is to be handled by the bindery line. The information includes:

(1) identification of the bindery lines;
(2) whether selective gathering or imaging is to be used;
(3) for selective gathering, packer boxes to be used and their relation to the selective gathering code;
(4) for selected imaging, message and label parameters and relation to the code;
(5) location of print stations and the type of ink jets in each;
(6) machine characteristics for the job, e.g., chain spacing.

The file may be prepared in advance and kept in the disk storage until it is to be used.

Immediately prior to the run of the job, it is necessary that the machine operator make appropriate mechanical adjustments in the bindery line and edit the software make-ready file described above to include information not available to the technical operator when the file is first constructed. The mechanical adjustments to the line may include such factors as physically setting the chain spacing; or placing the ink jets and book sensors in desired locations. After these mechanical adjustments are made, the software file is completed as by entering the phasing for the packer boxes or setting the timing for the ink jets, both of which will be described below.

Finally, in preparation for the production run, address information is transferred from disk storage at the main control to the line control. If more than one bindery line is to be used to perform a job, specified segments of the address file are transferred to the data processor of each line control. The production run or runs are then carried out at the bindery lines as described in the Abram et al. and Riley et al. patents.

Figure 4:
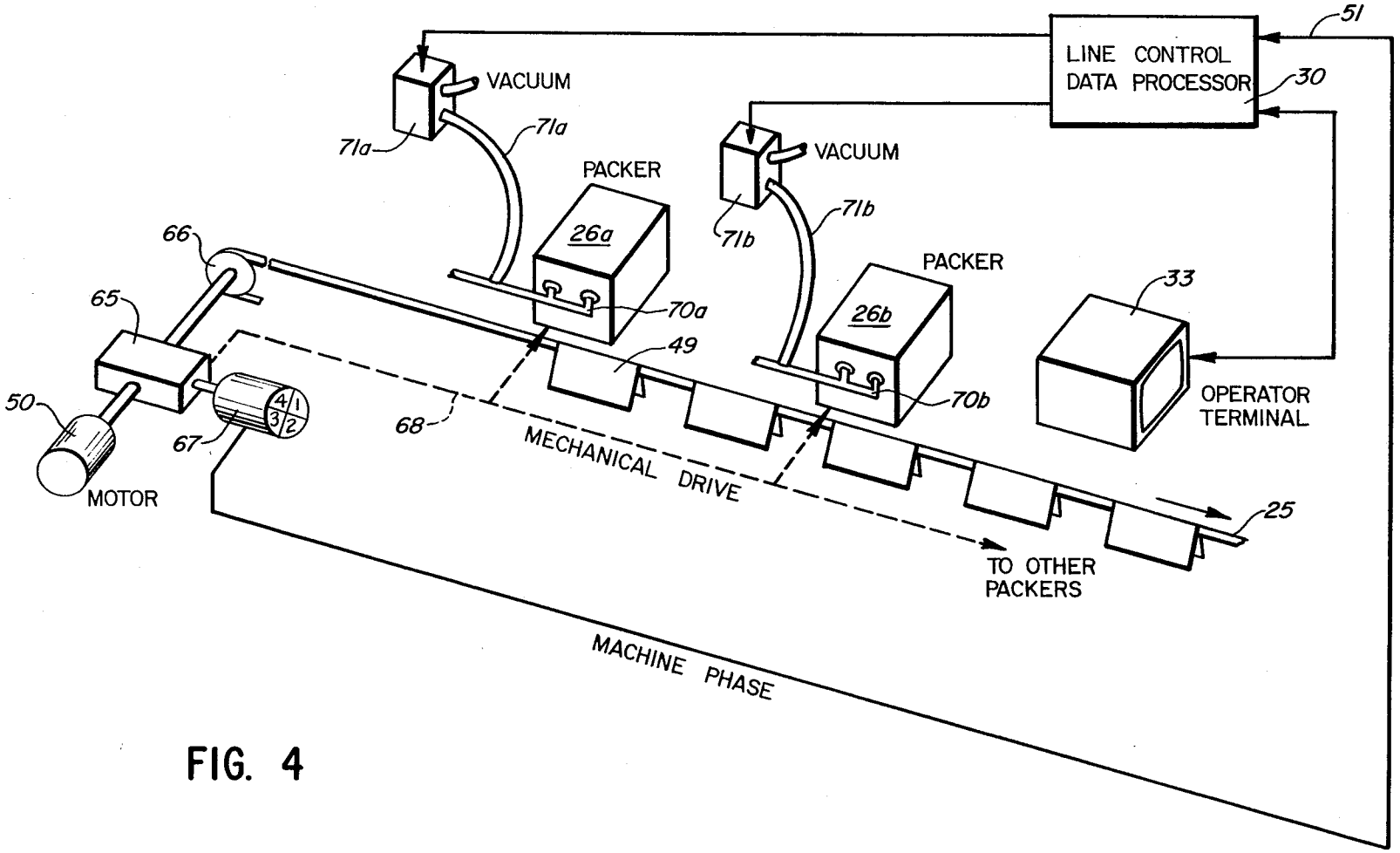
FIG. 4 is a diagram illustrating the timing of the signature pickup vacuum valves.

The signature delivery mechanism of a packer box 76 utilizes vacuum to pick a signature from the supply and initiate its delivery to chain 25. In selective assembly of a book, the vacuum is turned on or off during successive bindery line cycles, depending on whether a book being assembled at a particular position of the chain requires the signature from a particular packer box. The locations of the packer boxes along the chain are usually such that the signature delivery and mechanisms operate at different times. Moreover, the vacuum valves must be opened prior to the time that the sucker of a delivery mechanism engages a signature so that air in the system is exhausted. With prior DEC controls, the phasing of the packer box vacuum valves involved a modification of the computer program. This required considerable time on the part of a computer engineer or trained technician. The control disclosed herein provides for packer box phasing by the mechanical operator at the bindery line, as will be described in connection with FIG. 4.

The chain 25 is driven by a motor 50 connected through a gear box 65 with chain drive gear 66. A machine phase signal generator 67 is also driven by gear box 65 and generates a machine phase signal coupled to line control data processor 30 at 51.

The signature delivery mechanism for each of the packers *26a, 26b* is also driven by motor 50 through a mechanical connection from the gear box 65 as indicated by a broken line 68. A cycle of bindery machine operation is defined as the movement of chain 25 a distance corresponding with one chain space. During this machine cycle, the delivery mechanism for each of the packers operates through one cycle, although the position of the mechanism for different packers is likely to be different. The output of chain position sensor 67 is divided into four phases for each machine cycle. It has been found that four phases provide sufficient accuracy for setting the operation of the sucker vacuum valves.

Two packers *26a, 26b* are illustrated. The signature suckers *70a, 70b* are connected through hoses *71a, 71b* with a source of vacuum (not shown) through vacuum valves *71a, 71b*. The valves *71a, 71b* are operated by line control data processor 30 to apply vacuum to the suckers and to deliver a signature only when appropriate for the book being assembled, in accordance with coded information from the address file.

The machine operator through terminal 33 selects an adjust phase mode of operation as a part of the machine setup editing function. The chain 25 is moved slowly and the operator observes the phase of the machine cycle at which the suckers *70a, 70b* of each of the packers engage a signature. This phase information is communicated to the data processor 30 through the operator terminal 33 for each of the packers to be used for the job. With this input of information from the operator, the data processor 30 generates signals to open the valves 71 at the appropriate machine phase for each packer. To ensure reliable operation, the vacuum valves may be opened two phases prior to sucker engagement with the signature. This allows ample time to exhaust air in the suckers and connecting hoses.

Ink jet printer timing includes phasing as described in connection with the sucker vacuum valve operation and timing for message field location and for ink jet head location. In a typical ink jet printing installation, a plurality of ink jet heads adjacent chain 25 print a message as a book passes. Each head prints a different line of the message. The physical arrangement is illustrated diagrammatically and the operation will be described in connection with FIG. 5.

Chain 25 moves from right to left with three books 49*a*, 49*b* and 49*c* carried thereon and positioned against stops 25*a*. The distance between adjacent chain stops 25*a* define a chain position. Ink jet assembly 27 has six ink jet heads 27-1 through 27-6. The heads are carried on a mounting bar 75 which extends at an angle with respect to the book path. Each head will print a different line of a message as the book passes the ink jet assembly. Line spacing is selected by changing the angle of mounting bar 75.

A label demand source or sensor 53 senses the presence of a book and initiates the printing operation. The demand source may, for example, be a proximity sensor which responds to book pusher 25*a* or a photoelectric sensor which responds to the book itself. The first step in adjustment of the printer timing is to select the phase for the system to respond to an output from label demand sensor 53. This is done with the chain 25 moving at a slow speed. The operator observes the machine phase as indicated by phase generator 67 at the point in time when book pusher 25*a* is sensed by proximity sensor 53. This phase information is recorded for data processor 30 through operator terminal 33.

The printed message is represented by solid lines on book 49*c* which has passed the printing station and by dashed lines on book 49*a* which is approaching the printing station. A portion of book 49*b* has passed ink jet heads 27-1 through 27-4 and a corresponding portion of the message is shown by solid lines.

Figure 5:
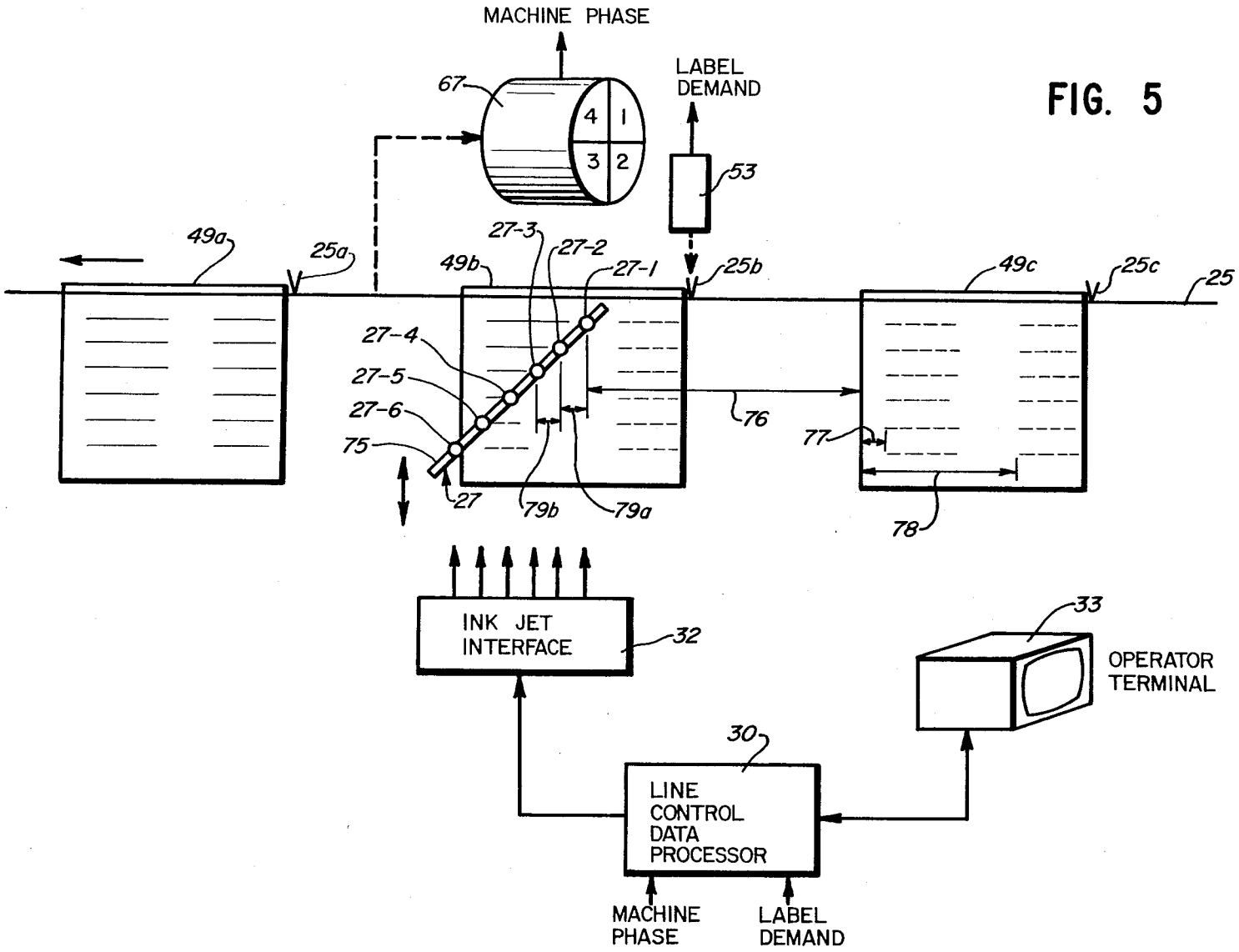
FIG. 5 is a diagram illustrating timing of the ink jet printers.

The system requires an appropriate timing delay following occurrence of a label demand signal from sensor 53 so that the message field will be printed at the proper location on the book. In FIG. 5 sensor 53 is physically located to respond to book pusher 25*b* and initiate the sequence of events that prints the following book 49*c*. Ink jet head 27-1 will be the first to operate. The delay for its operation from the occurrence of the label demand signal is the time required for chain 25 to move the book 49*c* a distance which is the sum of the dimension 76 between the leading edge of book 49*c* and head 27-1 and the dimension 77 between the edge of the book and the leading margin of the message. This information is communicated to the system through operator terminal 33. If the book is to have a plurality of message fields, the dimension 78 from the leading edge of the book to the margin of the second field is also entered. If more than two message fields are called for, the corresponding additional dimensions are specified. In addition to the message field dimensions, the machine operator also provides the dimensions 79*a*, 79*b*, etc. representing the head-to-head spacing of the ink jets on mounting bar 75. These dimensions are a function of the bar angle and must be changed if the angle is changed.

Line control data processor utilizes the dimensional information 76–79 in controlling ink jet interface 32 to cause each of the ink jet heads 27-1 through 27-6 to operate at the appropriate time.

We claim:

1. In a system for assembling and imaging books, having a main control with a data processor, a memory for control information and an operator terminal, a bindery line with means including packer boxes for gathering and assembling selected signatures to form a book and for imaging the book with a personalized message, a line control having a data processor with an operator terminal, the data processor being connected with the bindery line to control selection and assembly of signatures and imaging in accordance with the control information and a communication network between said data processors for transmitting control information from the main control to the line control, the method of controlling the bindery line, comprising;

creating a machine setup file with the physical characteristics of the bindery line;

maintaining said machine setup file with a memory at the main control data processor;

communicating the machine setup file to the line control of said bindery line in preparation for performing a binding run on said bindery line; and modifying said machine setup file for unique timing of the packer boxes for said binding run.

2. In a system for assembling and imaging books, having a main control with a data processor, a memory for control information and an operator terminal, a bindery line with means for gathering and assembling selected signatures to form a book and means for including an ink jet printer imaging the book with a personalized message, a line control having a data processor with an operator terminal, the data processor being connected with the bindery line to control selection and assembly of signatures and imaging in accordance with the control information and a communication network between said data processors for transmitting control information from the main control to the line control, the method of controlling the bindery line, comprising;

creating a machine setup file with the physical characteristics of the bindery line;

maintaining said machine setup file in a memory at the main control data processor;

communicating the machine setup file to the line control of said bindery line in preparation for performing a binding run on said binery line; and modifying the said machine setup file for unique timing of the ink jet printer for said binding run.

* * * * *

UNITED STATES PATENT AND TRADEMARK OFFICE

CERTIFICATE OF CORRECTION

PATENT NO. : 4,768,766

DATED : September 6, 1988

INVENTOR(S) : JOSEPH P. BERGER et al.

It is certified that error appears in the above-identified patent and that said Letters Patent is hereby corrected as shown below:

ON THE TITLE PAGE:

Change the name of the tenth named inventor from "Janet A. Wilczynski" to -- Janet A. Wilk --.

Signed and Sealed this

Fourteenth Day of March, 1989

*Attest:*

DONALD J. QUIGG

*Attesting Officer*

*Commissioner of Patents and Trademarks*